US011081801B2

(12) United States Patent
Chayat et al.

(10) Patent No.: US 11,081,801 B2
(45) Date of Patent: Aug. 3, 2021

(54) CAVITY BACKED ANTENNA WITH IN-CAVITY RESONATORS

(71) Applicant: VAYYAR IMAGING LTD., Yehud (IL)

(72) Inventors: Naftali Chayat, Kfar Saba (IL); Doron Cohen, Tel Aviv (IL)

(73) Assignee: VAYYAR IMAGING LTD., Yehud (IL)

( * ) Notice: Subject to any disclaimer, the term of this patent is extended or adjusted under 35 U.S.C. 154(b) by 0 days.

(21) Appl. No.: 16/802,610

(22) Filed: Feb. 27, 2020

(65) Prior Publication Data

US 2020/0212585 A1 Jul. 2, 2020

Related U.S. Application Data

(63) Continuation-in-part of application No. 16/403,628, filed on May 6, 2019, now Pat. No. 10,594,041, which is a continuation of application No. 15/853,996, filed on Dec. 26, 2017, now Pat. No. 10,283,832.

(51) Int. Cl.

| | |
|---|---|
| ***H01Q 13/18*** | (2006.01) |
| ***H01Q 1/48*** | (2006.01) |
| ***H01Q 9/30*** | (2006.01) |
| ***H01Q 9/10*** | (2006.01) |

(52) U.S. Cl.
CPC ..... *H01Q 13/18* (2013.01); *H01Q 1/48* (2013.01); *H01Q 9/10* (2013.01)

(58) Field of Classification Search
CPC ..... H01Q 13/18; H01Q 1/48; H01Q 9/30; H01Q 9/40; H01Q 1/38; H01Q 5/378; H01Q 5/25
See application file for complete search history.

(56) References Cited

U.S. PATENT DOCUMENTS

| | | | | |
|---|---|---|---|---|
| 8,860,532 | B2 * | 10/2014 | Gong | H01Q 9/32 333/202 |
| 10,444,340 | B2 * | 10/2019 | Nagaishi | H01Q 1/38 |
| 2008/0238793 | A1 * | 10/2008 | Channabasappa | H01Q 9/0457 343/767 |

OTHER PUBLICATIONS

Search Report in PCT Application No. PCT/IL2018/051 dated Mar. 6, 2019.

* cited by examiner

*Primary Examiner* — Dimary S Lopez Cruz
*Assistant Examiner* — Michael M Bouizza
(74) *Attorney, Agent, or Firm* — Mark Cohen; Pearl Cohen Zedek Latzer Baratz

(57) ABSTRACT

A compact wideband RF antenna for incorporating into a planar substrate, such as a PCB, having at least one cavity with a radiating slot, and at least one transmission line resonator disposed within a cavity and coupled thereto. Additional embodiments provide stacked slot-coupled cavities and multiple coupled transmission-line resonators placed within a cavity. Applications to ultra-wideband systems and to millimeter-wave systems, as well as to dual and circular polarization antennas are disclosed. Further applications include configurations for an antenna based on a monopole element and having a radiation pattern that is approximately isotropic.

22 Claims, 10 Drawing Sheets

CAVITY BACKED ANTENNA WITH IN-CAVITY RESONATORS

CROSS REFERENCE TO RELATED APPLICATION

This application is a Continuation-In-Part of U.S. patent application Ser. No. 16/403,628, filed May 6, 2019, entitled "Cavity backed slot antenna with in-cavity resonators", the priority of which is hereby claimed.

FIELD

The present invention relates to radio frequency antennas, and in particular to cavity-backed antennas and monopole antennas employed in communications, radar and direction finding, and microwave imaging technologies, and notably including antennas having approximately isotropic radiation patterns.

BACKGROUND

Antennas are critical components in communications, radar and direction finding systems, interfacing between the RF circuitry and the environment. RF circuitry is often manufactured using printed circuit board (PCB) technology, and numerous engineering and commercial advantages are realized by integrating the RF antennas directly on the same printed circuit boards as the circuitry. Doing so improves product quality, reliability, and form-factor compactness, while at the same time lowering manufacturing costs by eliminating fabrication steps, connectors, and mechanical supports.

There is a variety of PCB antennas, including microstrip patch antennas that radiate perpendicularly to the PCB, slot antennas that radiate perpendicularly to the PCB in both directions, and printed Vivaldi and Yagi antennas that radiate parallel to the surface of the PCB. Cavity-backed antennas were implemented in PCB technology as well, especially at the higher frequencies. These antennas have dimensions on the order of the half-wavelength of the operating frequency, and at lower frequencies consume considerable PCB area.

Because of close proximity to the ground plane, however, PCB RF antennas typically have a narrow-band response, which is disadvantageous when wideband performance is needed, such as for ultra-wideband (UWB) operation in the 3.1-10.6 GHz band, or even a 6-8.5 GHz sub-band. Additional applications of interest are millimeter wave bands of the 57-71 GHz ("60 GHz") ISM band, 71-76 GHz and 81-86 GHz communications bands, and the 76-81 GHz automotive radar band. Covering these bands, or combinations thereof calls for antennas with large fractional bandwidth.

Thus, it would be desirable to have PCB antennas with enhanced bandwidth and improved wide-band matching characteristics. This goal is met by embodiments of the present invention.

In certain applications, it is desirable to have PCB antennas with radiation patterns which are approximately isotropic. This goal is met by embodiments of the present invention.

SUMMARY

Antennas according to embodiments of the present invention include: at least one cavity in a planar substrate, such as a printed circuit board, integrated circuit, or a similar substrate; a radiating slot; and at least one strip resonator situated within a cavity, such that the signal port is coupled to a strip resonator. Locating a strip resonator within a cavity increases the efficiency and versatility of the antenna, while conserving space and allowing more volume and thickness to the cavity. Embodiments of the invention thereby provide antennas for PCBs and other planar substrates with both improved compactness form-factors and improved bandwidth characteristics.

Non-limiting examples according to embodiments of the present invention include a PCB antenna on a 1.6 mm thick FR4 substrate covering the 6-8.5 GHz band, and an antenna on a 1 mm thick PCB antenna covering a 57-90 GHz band.

The term "planar substrate" herein denotes a substrate whose surface substantially lies in a plane, which is arbitrarily referred to as a "horizontal" plane. With reference to the coordinate system legends in the accompanying drawings, the horizontal plane is denoted as the x-y plane, and the vertical direction is orthogonal thereto and denoted as the z-direction. Extents of width and length are expressed in the horizontal x-y plane, and extents of height, depth, and thickness are expressed in the z-direction. In various embodiments of the invention, the substrate's dimensions in the horizontal plane (i.e., its length and width) are substantially larger than the dimensions thereof in the vertical direction (i.e., its thickness). In certain embodiments of the present invention, a planar substrate is a PCB; in other embodiments, a planar substrate is an integrated circuit substrate. It is understood that descriptions and figures herein of embodiments relating to printed circuit boards are for illustrative and exemplary purposes, and are non-limiting. Operating principles of embodiments based on printed circuit board technology are in many cases also applicable to embodiments based on other technologies, such as integrated circuit technology.

According to embodiments of the invention, a planar substrate is formed of a dielectric material and contains electrically-conductive layers which extend horizontally within the substrate substantially parallel to the plane of the substrate. In PCB's, electrically-conductive layers are typically metallization layers.

According to embodiments of the present invention, a cavity in a planar substrate is a volumetric region containing a portion of the dielectric material of the substrate, and substantially bounded by portions of the electrically-conductive layers of the planar substrate to form a radio frequency (RF) cavity for electromagnetic fields. In certain embodiments, the horizontal boundaries of a cavity include portions of the horizontal electrically-conductive layers. In certain embodiments, such as those related to PCB use, the vertical boundaries of a cavity are formed by vertical electrical interconnections (e.g., vias) between adjacent horizontal metallization layers.

It is understood and appreciated that antenna embodiments according to the present invention include both transmission and reception capabilities. In descriptions herein where excitation of the antenna for transmission is detailed, it is understood that this is non-limiting, and that the same antenna is also capable of reception. Likewise, in cases of reception, the same antenna is also capable of transmission. Thus, for example, a "radiating slot aperture" (herein also denoted as a "radiating slot") is understood to be capable of receiving incoming electromagnetic radiation, in addition to transmitting outgoing electromagnetic radiation. In particular, various embodiments of the present invention are suitable for use in Radar, where a single antenna can handle both transmission and reception of signals.

Various embodiments of the invention feature different shapes for the radiating slot, including, but not limited to: a linear slot; an I-shaped (or H-shaped) slot; and a bow tie shaped slot.

Resonant transmission-line elements according to embodiments of the invention lie within the cavity and have a variety of boundary conditions. In some embodiments, a transmission line resonator is open at both ends; in other embodiments, a transmission line resonator is open at one end and shorted to ground at the other end.

In a related embodiment, the radiating slot is backed by a cavity having two transmission-line resonators disposed therein. The first transmission line resonator is excited by RF circuitry via a feed line, and the second transmission line resonator is excited by electromagnetic coupling to the first transmission line resonator. The cavity is excited primarily by the second resonator, and the radiating slot of the antenna is excited primarily by the fields within the cavity.

Another related embodiment features two vertically stacked cavities, with a coupling slot between the two cavities. The upper cavity includes in its top surface a radiating slot, wherein the lower cavity includes a half-wave open-open resonator driven by a feed line. (In this non-limiting embodiment, the upper cavity is the radiating cavity, and radiates upward; by rotating the configuration, of course, the terms "upper" and "lower" are interchanged, and the antenna radiates downward.)

Further embodiments of the present invention provide a monopole element with a short extension pad at one end and having a radiation pattern which is approximately isotropic (herein denoted as "quasi-isotropic").

Therefore, according to an embodiment of the present invention, there is provided a radio-frequency (RF) antenna for a planar substrate, the antenna including: (a) a multiplicity of electrically-conductive layers within the planar substrate; (b) a lower cavity within the planar substrate, the lower cavity bounded by a bottom ground plane, by vertical sidewalls formed of electrically-interconnected portions of the electrically-conductive layers, and by a middle ground plane; (c) an upper cavity recess within the planar substrate, the upper cavity recess bounded by the middle ground plane and by vertical sidewalls formed of electrically-interconnected portions of the electrically-conductive layers; wherein the middle ground plane has a slot which electromagnetically couples the lower cavity to the upper cavity recess; (d) a monopole element electrically-connected at a lower end to the lower ground plane and extending into the upper cavity recess; wherein the monopole element is electrically-connected to a conducting strip within the lower cavity to form a lower resonator; and wherein the monopole element is electrically-connected at an upper end to a conducting pad within the upper cavity recess to form an upper resonator for radiating and receiving RF signals; and (e) an input coupling in the lower cavity, for electromagnetically coupling the lower resonator to RF circuitry.

In addition, according to another embodiment of the present invention, there is also provided a radio-frequency (RF) antenna for a planar substrate, the antenna including: (a) a dielectric material within the planar substrate; (b) a multiplicity of electrically-conductive layers within the planar substrate; (c) a recess in an upper surface of the planar substrate; (d) a cavity within the planar substrate below the recess, the cavity containing a portion of the dielectric material and bounded by portions of the electrically-conductive layers and by vertical sidewalls formed of electrically-interconnected portions of the electrically-conductive layers; (e) an antenna feed, for electromagnetically coupling the antenna to RF circuitry; (f) a first resonator for radiating and receiving RF signals for electromagnetically coupling the antenna to an external RF field, the resonator including a monopole element in the cavity; and (g) a second resonator including a horizontal transmission line in the cavity; wherein: the monopole element is electrically-connected at a lower end to a ground plane of the cavity and extending into the recess; the monopole element is electrically-connected at an upper end to a conducting pad within the recess; at least one of the horizontal transmission line resonators is electromagnetically coupled to the antenna feed; and at least one of the transmission line resonators is electromagnetically coupled to the monopole element.

BRIEF DESCRIPTION OF THE DRAWINGS

The subject matter disclosed may best be understood by reference to the following detailed description when read with the accompanying drawings in which.

Figure 1:
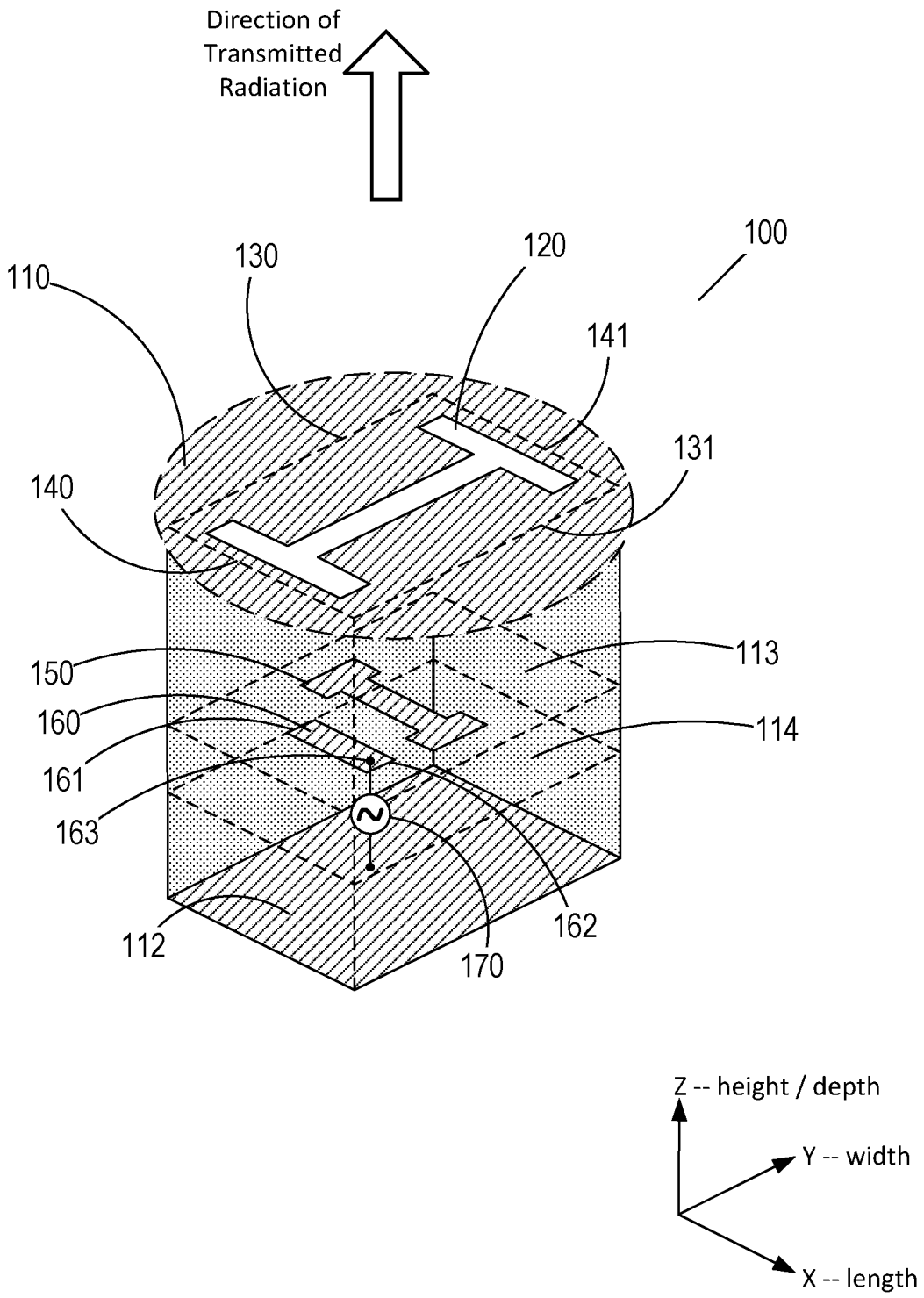
FIG. 1 is an isometric view of a cavity-backed slot antenna in a PCB, which is fed by two in-cavity transmission line resonators according to an embodiment of the present invention.

For simplicity and clarity of illustration, elements shown in the figures are not necessarily drawn to scale, and the dimensions of some elements may be exaggerated relative to other elements. In addition, reference numerals may be repeated among the figures to indicate corresponding or analogous elements.

To define the orientations of the illustrated elements, the drawings show the respective applicable coordinate system references. The direction along which the resonators are situated is denoted herein as the "x"-direction, with reference to the resonator "length"; the direction along which the radiating slots are situated is denoted herein as the "y"-direction, with reference to the slot "width"; and the direction along which the PCB layers are situated is denoted herein as the "z"-direction, with reference to the "height" or "depth" of elements with respect to the PCB strata.

DETAILED DESCRIPTION

FIG. 1 is an isometric view of an RF cavity-backed slot antenna 100 in a PCB, according to an embodiment of the present invention. A PCB top surface (only a portion of which is shown) is metallized to form a ground plane 110. A PCB bottom surface 112 is also metalized. A slot is etched in ground plane 110 to form a radiating slot 120, with transmitted radiation in the z-direction as shown. Slot 120 is backed by a cavity formed by sidewalls 130, 131, 140, and 141 (the intersections of which with top surface ground plane 110 are shown as dashed lines), top surface 110 and bottom surface 112, all of which are electrically conductive. The cavity is filled with a dielectric formed by the PCB substrate material. Cavity side walls 130, 131, 140, and 141 are typically fabricated by vertical "via" holes—holes with metallized sidewalls interconnecting the metallization layers of the PCB. In the embodiment of FIG. 1, two in-cavity resonators are present: a stepped-impedance open-open transmission line resonator 150, and a "short-open" transmission line resonator 160 (which is short-circuited to sidewall 130 at an end 161, and is open-circuited at an end 162). Resonators 150 and 160 are situated in PCB internal metallization layers 113 and 114, respectively. Resonator 160 is driven by an RF source 170 connected to resonator 160 at a point 163, in various ways according to additional embodiments of the invention, as described herein. (RF circuitry is not shown in the figures.)

Figure 2:
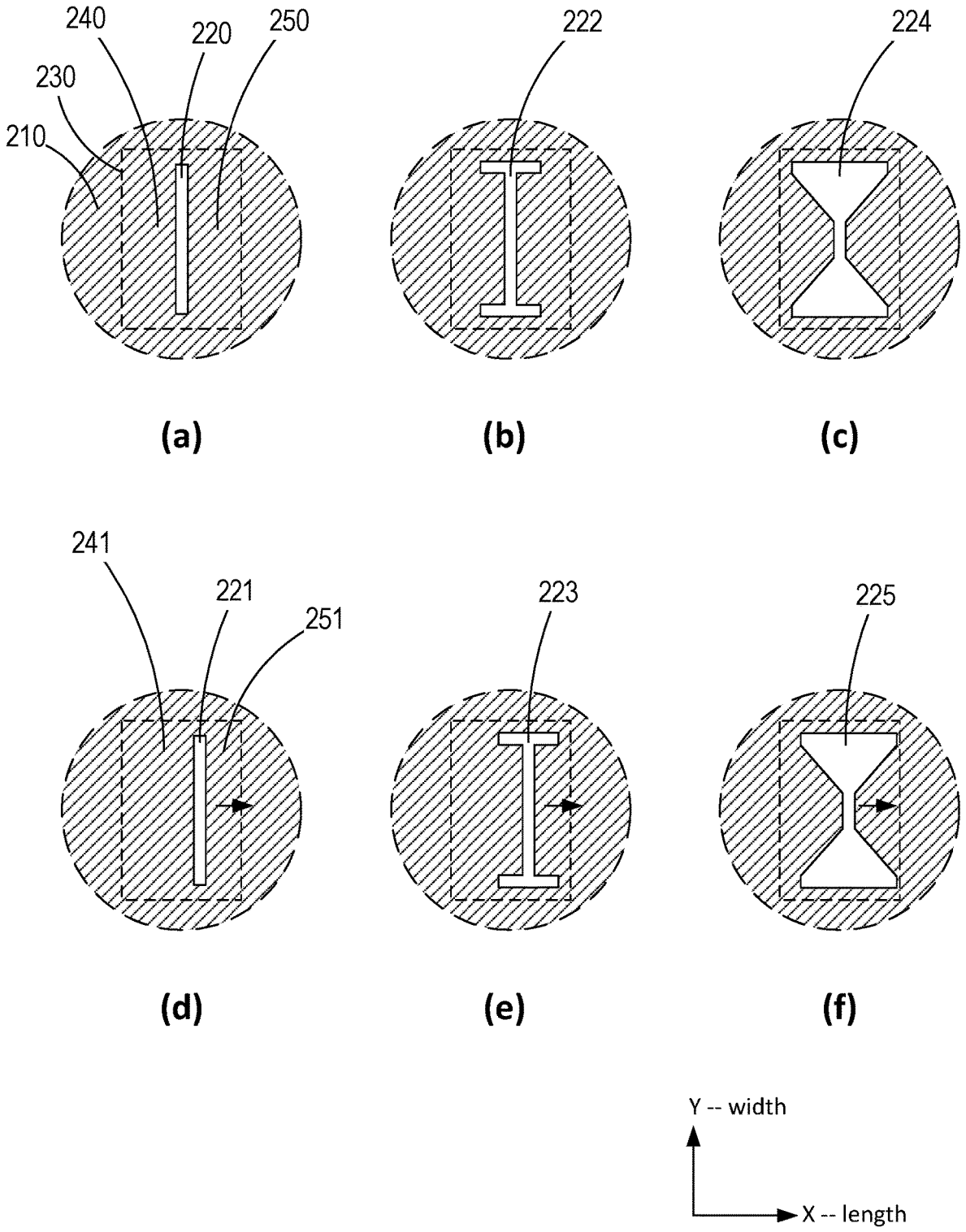
FIG. 2 illustrates a variety of non-limiting examples of antenna slot shapes according to embodiments of the present invention.

FIG. 2 illustrates configurations of radiating slots in a PCB ground plane 210 above a cavity having an intersection 230 (shown as a dashed line) with ground plane 210, according to several embodiments of the invention: FIG. 2 (*a*) shows a linear slot 220; FIG. 2 (*b*) shows an I-shaped (or H-shaped) slot 222; and FIG. 2 (*c*) shows a bow tie-shaped slot 224. These embodiments are non-limiting, as other shapes are also possible.

FIG. 2 (*d*), FIG. 2(*e*), and FIG. 2 (*f*) show variants of the above slots offset from the cavity center. FIG. 2 (*d*) shows an offset linear slot 221; FIG. 2 (*e*) shows an offset I-shaped slot 223; and FIG. 2 (*f*) shows an offset bow tie-shaped slot 225. As noted above, additional offset shapes are also possible.

A metallization 240 on one side of the slot, and a metallization 250, on the other side of the slot, herein denoted as "flaps", define two sub-cavities. When the depth of the cavity is small relative to the length of the cavity, the flaps define two "short-open" resonators. In embodiments where the slot is offset from the center, flaps 241 and 251 have different resonant frequencies. This separation of frequencies allows further broadbanding of the antenna.

Figure 3:
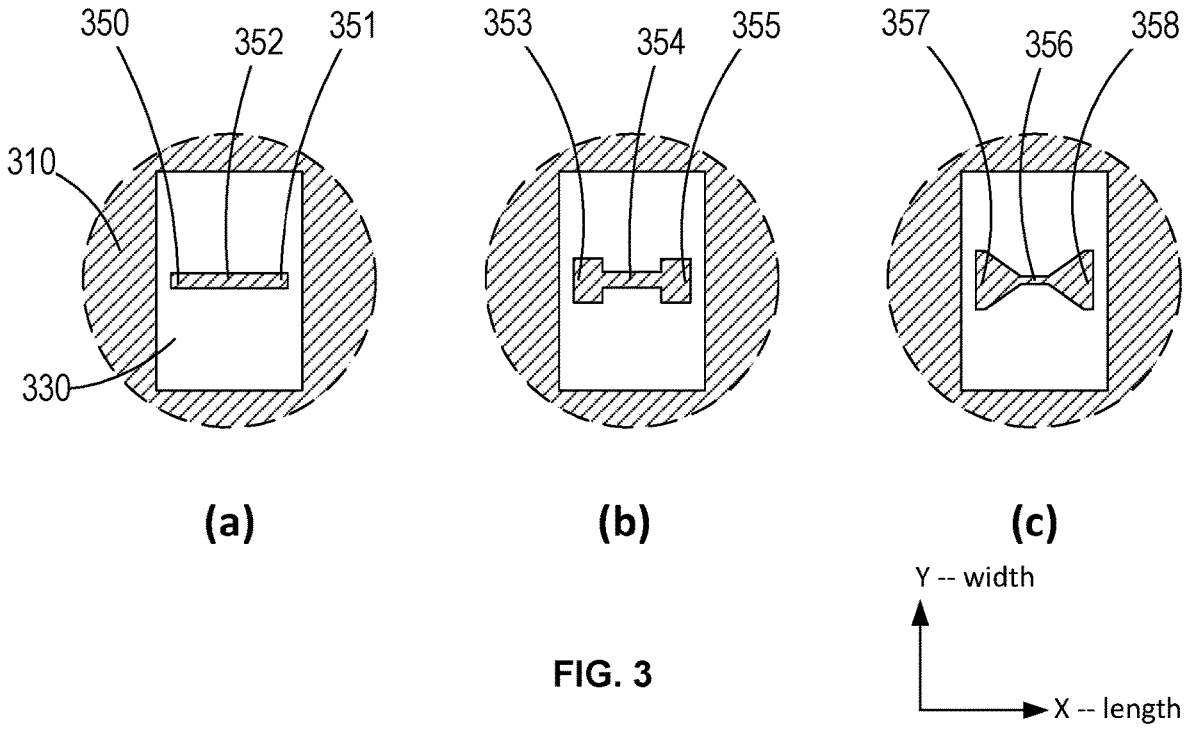
FIG. 3 shows a variety of non-limiting examples of in-cavity open-open transmission line resonator shapes according to embodiments of the present invention.

FIG. 3 illustrates configurations of intermediate "open-open" resonators in a PCB cavity 330 surrounded by a ground plane 310 according to several embodiments of the invention. FIG. 3 (*a*) illustrates a linear resonator 352 having an open-circuit side 350 and an open-circuit side 351; in addition to uniform resonators of this sort, FIG. 3 (*b*) illustrates a stepped-impedance dumbbell-shaped resonator 354 having an open-circuit side 353 and an open-circuit side 355; and FIG. 3 (*c*) illustrates a tapered-impedance bow tie-shaped resonator 356 having an open-circuit side 357 and an open-circuit side 358. These embodiments are non-limiting, as other shapes are also possible.

Stepped-impedance resonators (such as resonator 354) are typically used to physically shorten the resonator for a better fit within the cavity. In FIG. 3 ground plane 310 has "open-open" resonators contained within cavity 330. The two sides of the respective resonators form "quarter wave" sections, which in typical cases are coupled, respectively, to flaps 241 and 251 of FIG. 2. The amount of coupling between the resonator and the slot is controlled by the height at which the resonator is situated and by its width. Just as the slot can be offset from the center of the length, so can the resonator be offset, so that the relative amount of coupling of one side to flap 241, and the other side to flap 251 can be controlled. As noted previously, the implications and the benefits of using offset configurations are disclosed below.

Figure 4:
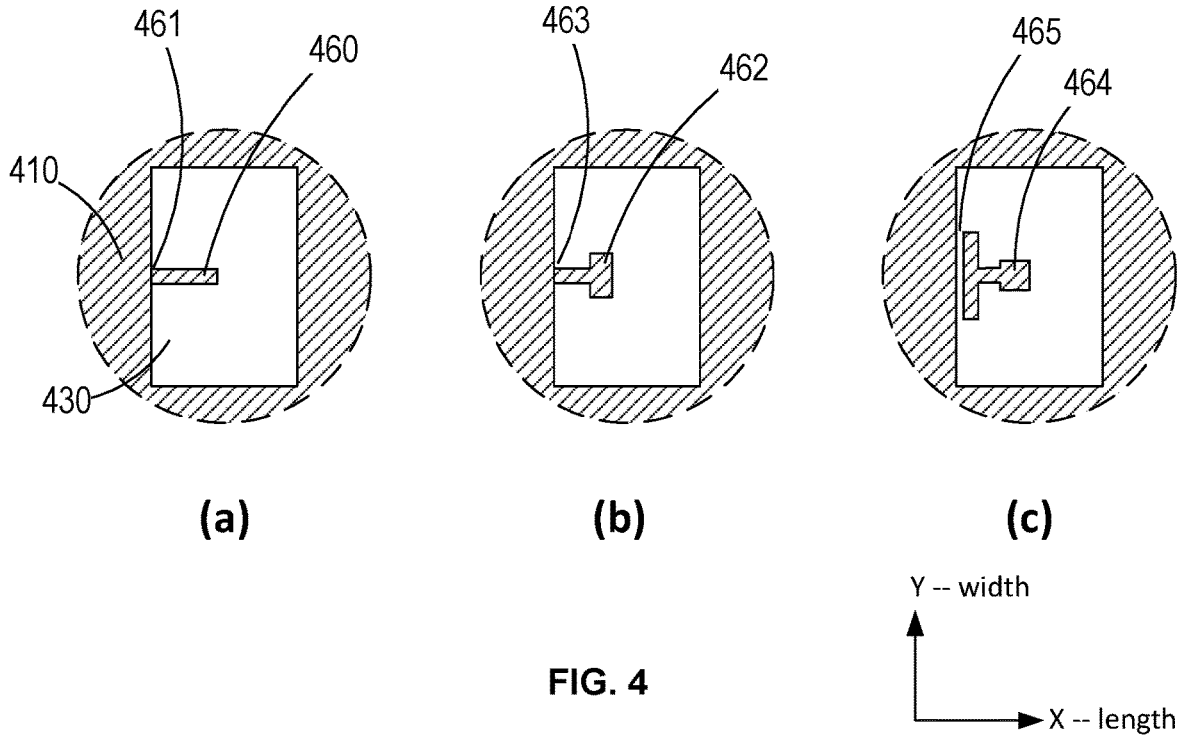
FIG. 4 shows a variety of non-limiting examples of in-cavity short-open transmission line resonator shapes according to embodiments of the present invention.

FIG. 4 illustrates configurations of "short-open" resonators, which are typically used as driven elements, in a PCB cavity 430 surrounded by a ground plane 410 according to several embodiments of the invention. FIG. 4 (*a*) illustrates a linear resonator 460 having a short-circuit connection 461 to ground plane 410; FIG. 4 (*b*) illustrates a stepped-impedance resonator 462 having a short-circuit connection 463 to ground plane 410; and FIG. 4 (*c*) illustrates a stepped-impedance resonator 464 having a capacitive stub 465 serving in place of a short-circuit connection to ground plane 410. The configuration of FIG. 4 (*c*) is beneficial if galvanic (direct current) contact with ground plane 410 is to be avoided. These embodiments are non-limiting, as other shapes are also possible.

In FIG. 4, the resonator is typically close to the cavity edge—and in 4 (*a*) and 4 (*b*) the resonator is galvanically-connected to the cavity edge—so that a resonator of FIG. 4 and one of the sides of an "open-open" resonator of FIG. 3 together approximate a quarter wave coupled section. The amount of coupling between a "short-open" resonator of FIG. 4 and an "open-open" resonator of FIG. 3 is controlled by the respective heights at which the resonators are situated and by their respective widths.

Figure 5:
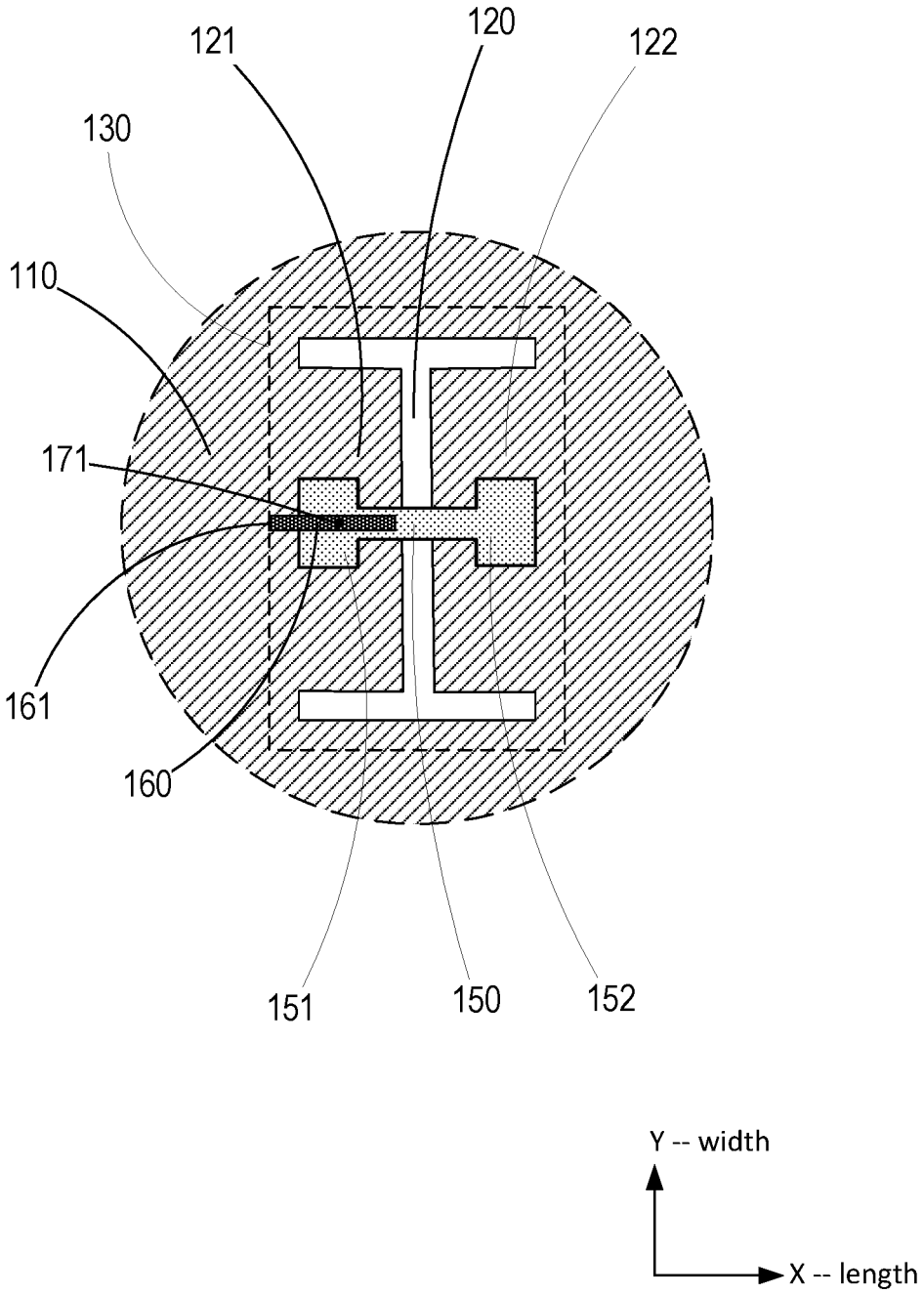
FIG. 5. Illustrates relative position in the X-Y plane of resonators, according to embodiments of the present invention.

FIG. 5 shows a plan view of the antenna of FIG. 1, to illustrate the relative placement of the antenna components. FIG. 5 shows the antenna from the bottom side, with ground plane 112 removed. Intermediate resonator 150 extends across slot 120, so that sides 151 and 152 extend under slot 120's two side flaps 121 and 122, respectively. The transmission line resonator 150 is coupled to "short-open" resonator 160 in view of their overlap in the x-y plane. Resonator 160 has a short-circuit connection 161 to sidewall 130. The coupling factors between the resonators are determined by their respective heights above ground plane 112 (not shown in FIG. 5), the spacing between the resonators in the z-direction, their amount of overlap in the x-direction, and by their widths in the y-direction. Typically, the heights of the resonators are chosen within the constraints of PCB manufacturing technology ("stackup" of the layers), so that the resonator dimensions and amount of overlap are modified to adjust the coupling factors between the resonators in the antenna. The location of a feed point 171 along resonator 160 determines the coupling factor to resonator 160. The overall set of coupling factors determines the frequency response of the antenna and is chosen to provide a uniform response over the frequency range of interest.

Figure 6:
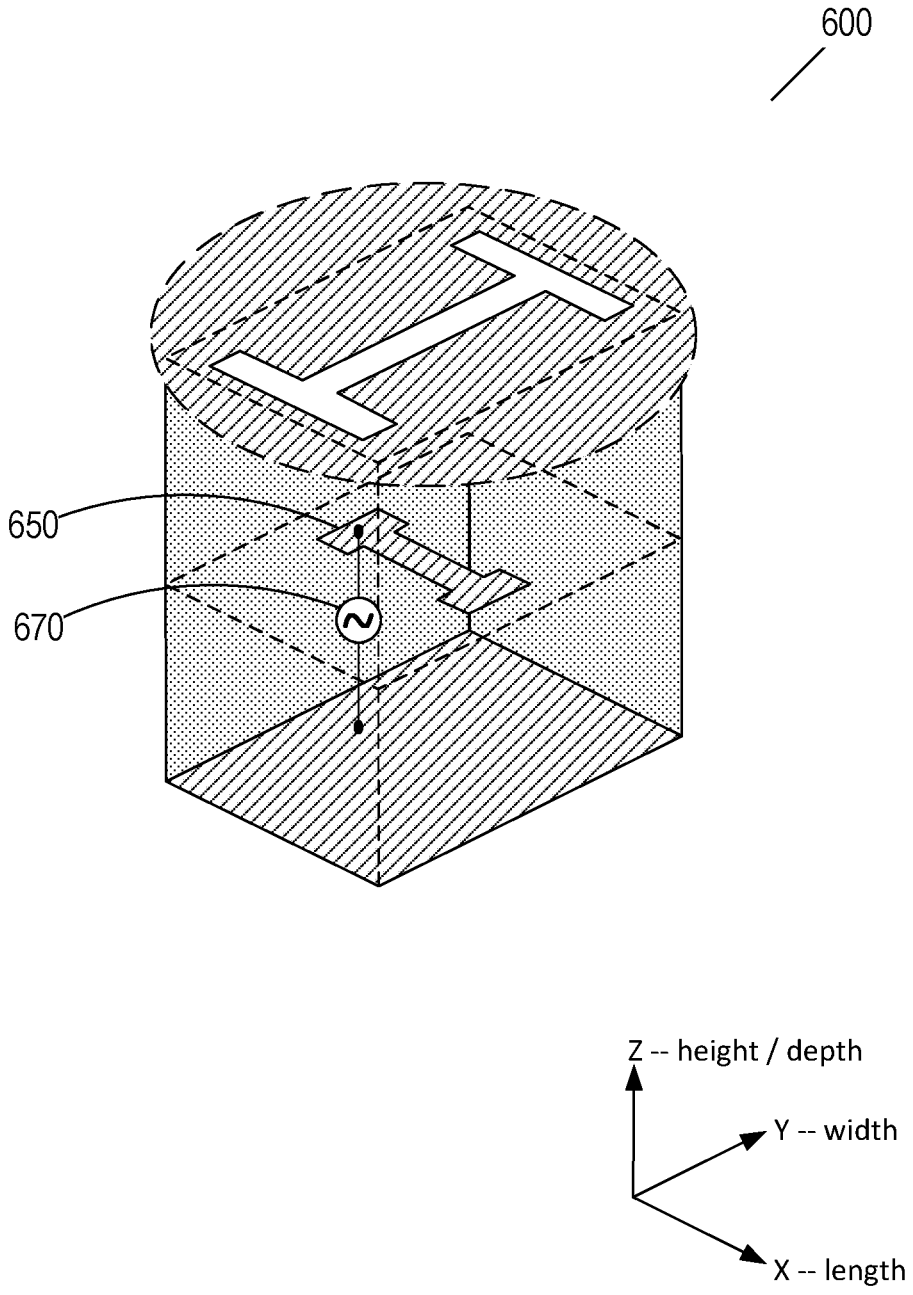
FIG. 6 is an isometric view of a cavity-backed slot antenna on a PCB which is fed by an open-open in-cavity transmission line resonator according to an embodiment of the present invention.

FIG. 6 shows an antenna 600 according to another embodiment of the present invention, wherein the cavity contains only one "open-open" resonator 650, which is directly driven by an input source 670. Antenna 600 permits simpler PCB stackups, at the expense of reducing the order of the filter in the antenna.

Figure 7:
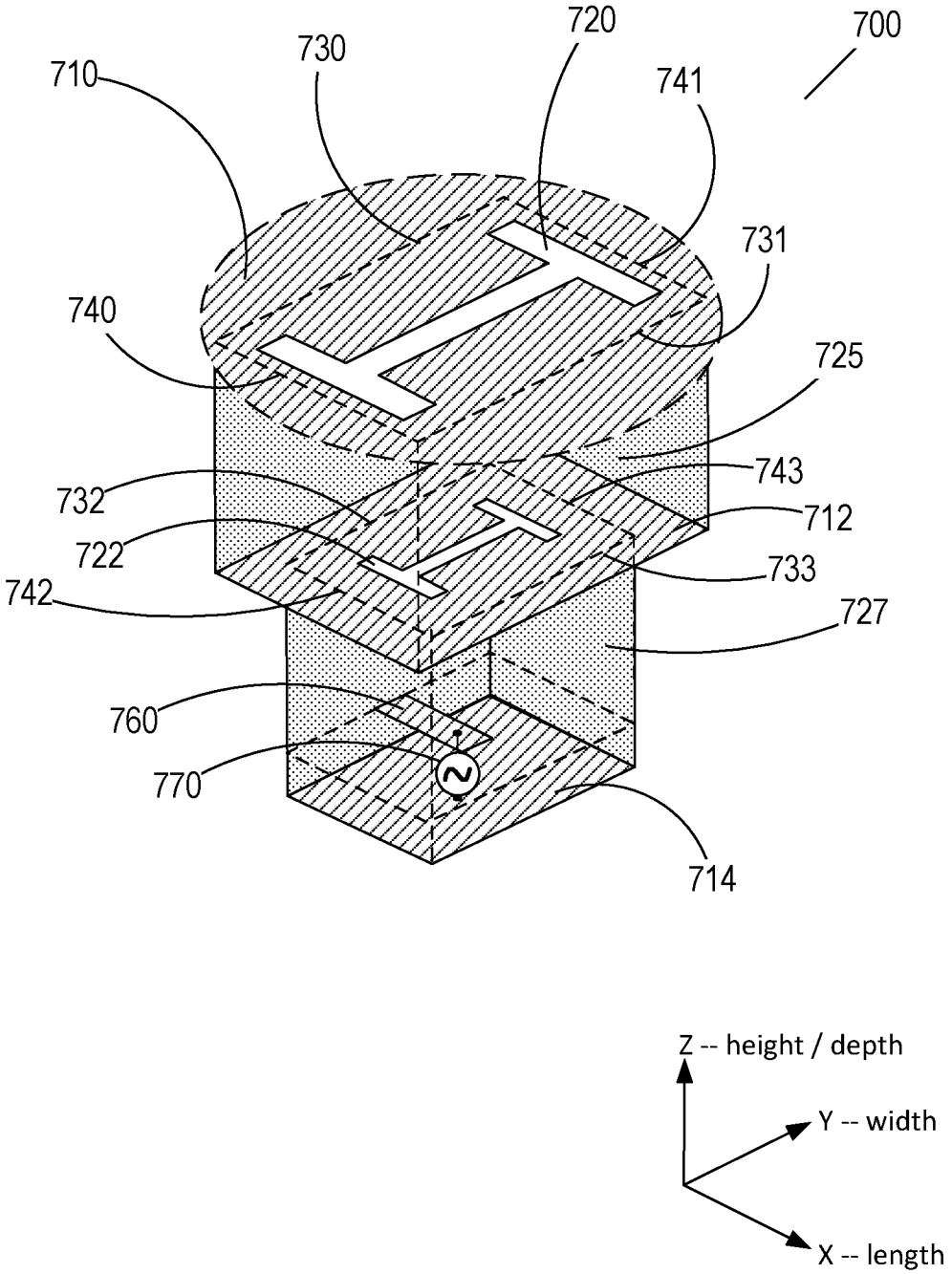
FIG. 7 is an isometric view of a cavity-backed slot antenna on a PCB having two vertically stacked slot-coupled cavities according to an embodiment of the present invention.

FIG. 7 illustrates an antenna 700 according to an embodiment of the present invention, in which there are two vertically stacked PCB cavities: an upper cavity 725 having sidewalls 730, 731, 740, and 741 (shown as dashed lines); and a lower cavity 727 having sidewalls 732, 733, 742, and 743 (shown as dashed lines). Lower cavity 727 is coupled to upper cavity 725 through a slot 722 in a surface 712 which is common to both cavities. A top surface 710 contains a radiating slot 720. Lower cavity 727 contains therein a "short-open" resonator 760 that couples to lower cavity 727. Antenna 700 forms a filter structure, with transmission line resonator 760, lower cavity 727 and upper cavity 725 being coupled in tandem to achieve broadband response.

Antenna 700, with two PCB cavities one above the other is particularly applicable to antenna arrays, where one objective is to pack multiple antennas with a high surface density. This is advantageous over current technologies such as SIW (surface integrated waveguide) antennas coupled to additional SIW resonators which are laterally displaced in the same plane and thereby consume excessive PCB surface area.

In-cavity transmission line resonators according to embodiments of the current invention typically have narrow width dimension relative to the length dimension, as opposed to patch antennas. The purpose of the cavity elements of the present invention is not to radiate, but rather to couple energy to the radiating cavity-slot combination.

According to related embodiments of the current invention, transmission line resonators are offset from the center of the cavity in the y-direction, to advantageously alter the coupling factor between the resonator and the cavity, as previously discussed.

In another embodiment of the invention, transmission line resonators (such as resonators 150 and 160 of FIG. 1) are placed side by side at the same height within a cavity, so that the resonators are side-coupled rather than broadside-coupled.

As previously noted regarding the above descriptions directed to PCB technology, it is understood by those skilled in the art that embodiments of the present invention are also applicable to other technologies which feature multiple layers of dielectric and various forms of electrically-conductive layers, such as LTCC (low-temperature co-fired ceramic) and other implementation of high-frequency antennas on integrated circuits.

Figure 8:
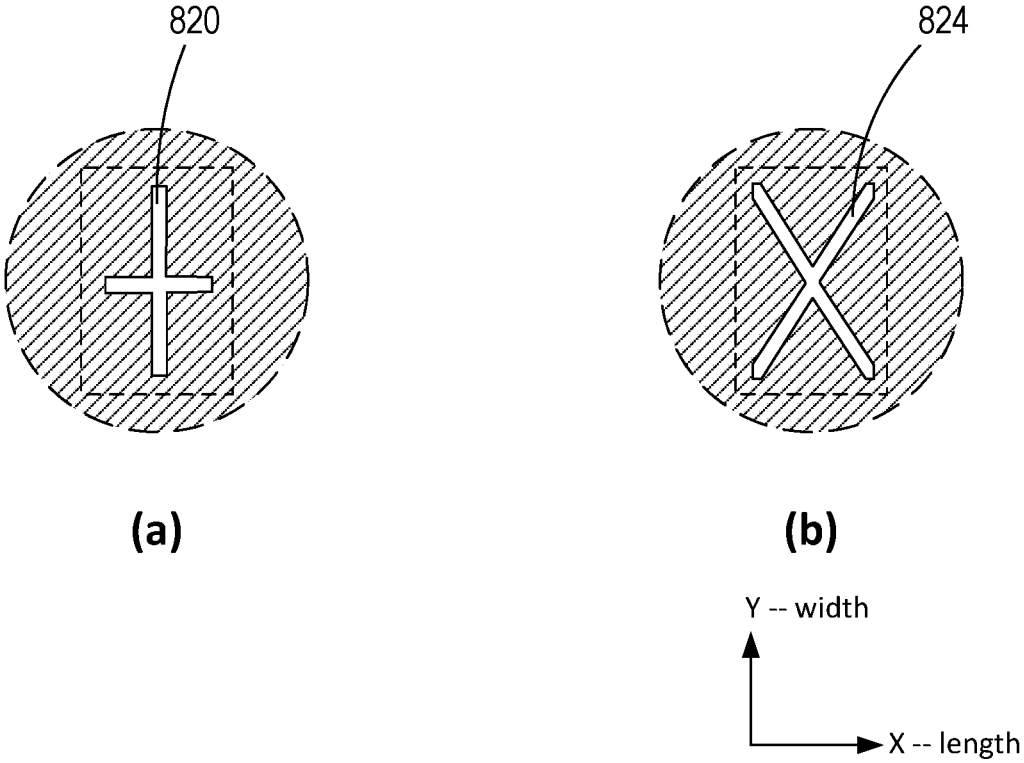
FIG. 8 illustrates slot shapes for dual polarization and circular polarization according to certain embodiments of the present invention.
Figure 9:
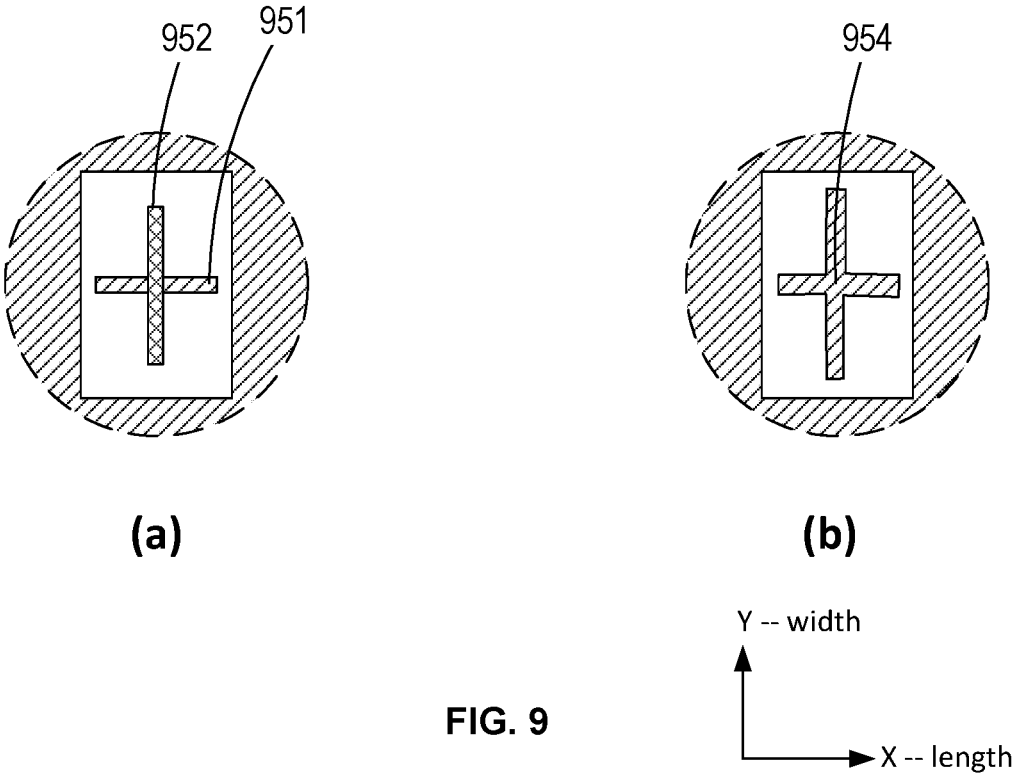
FIG. 9 illustrates transmission line resonator shapes for dual polarization and circular polarization according to other embodiments of the present invention.

It is also understood by those skilled in the art that embodiments of the present invention are also applicable to dual and circular polarization antennas. By having cavities and slots resonant in both x and y dimensions, and by having in-cavity transmission line resonators supporting more than one resonance mode, an antenna can function for multiple polarizations. FIG. 8 (*a*) illustrates a slot 820 with a "+" shape, and FIG. 8 (*b*) illustrates a slot 824 with an "x" shape—these have resonant modes in both the "x" and "y" directions. Resonances can be at the same or different frequencies, according to the relative dimensions. FIG. 9 (*a*) illustrates a resonator 951 and an orthogonally-oriented resonator 952, which together support resonances in both "x" and "y" polarizations; and FIG. 9 (*b*) illustrates a "+" shaped resonator 954 to support two resonant modes. In another embodiment, separate feed resonators are used for each polarization; in a further embodiment, a single feed is used to couple to both polarizations. The above-mentioned features can be used in antennas including, but not limited to: dual polarization antennas at same frequency band with two feed points; dual polarization antennas with different (and possibly overlapping) frequency bands with two feed points; dual polarization dual self-diplexing band antennas; circular polarization antennas, by frequency-staggering resonance frequencies in two polarizations; circular polarization antennas, by 90-degree feeding of the two polarization; and dual-circular polarization antennas by quadrature-hybrid based feeding of the two polarizations.

Figure 10:
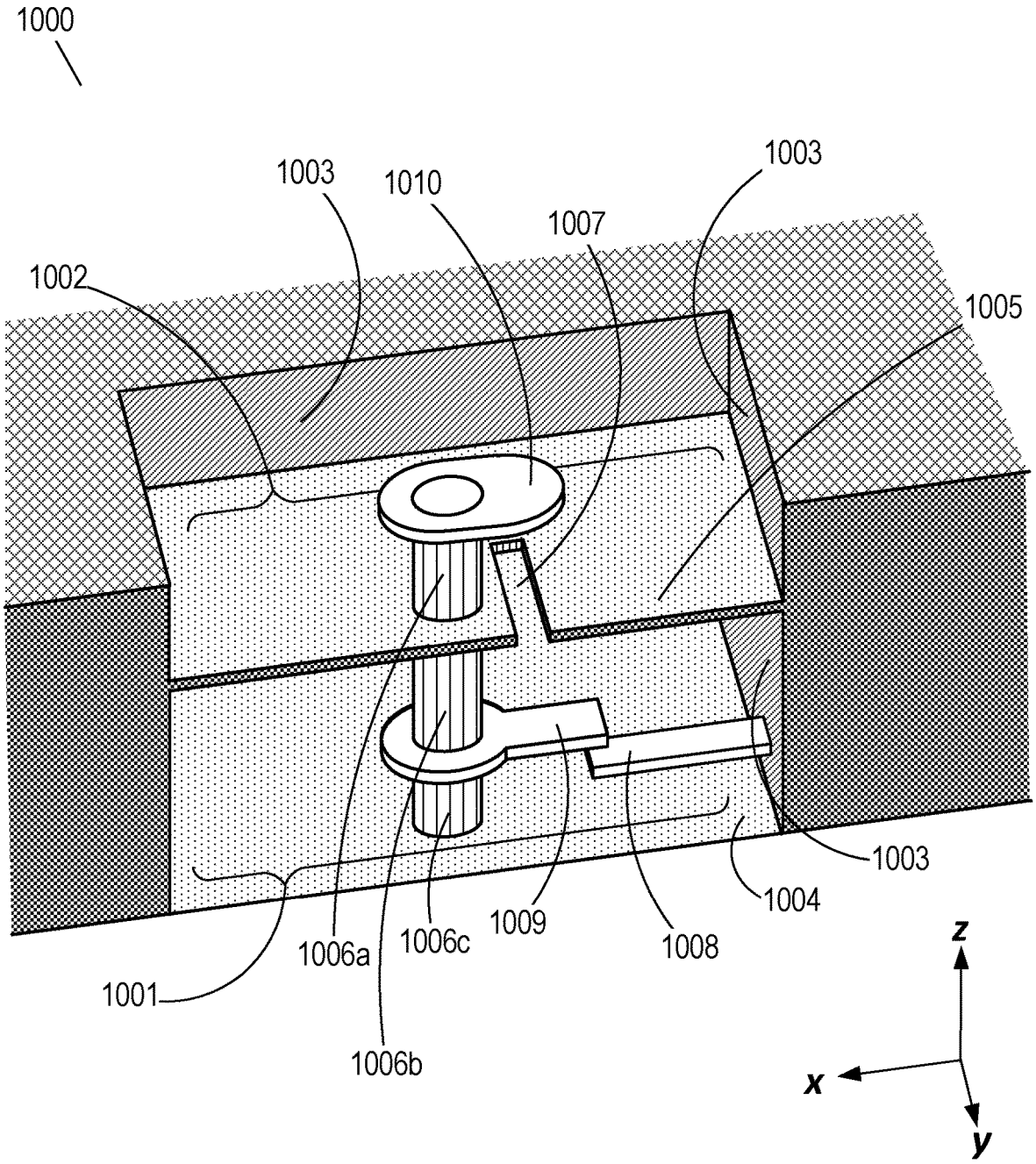
FIG. 10 illustrates a coupled dual resonator monopole element configuration for a quasi-isotropic antenna, according to an embodiment of the present invention.
Figure 11:
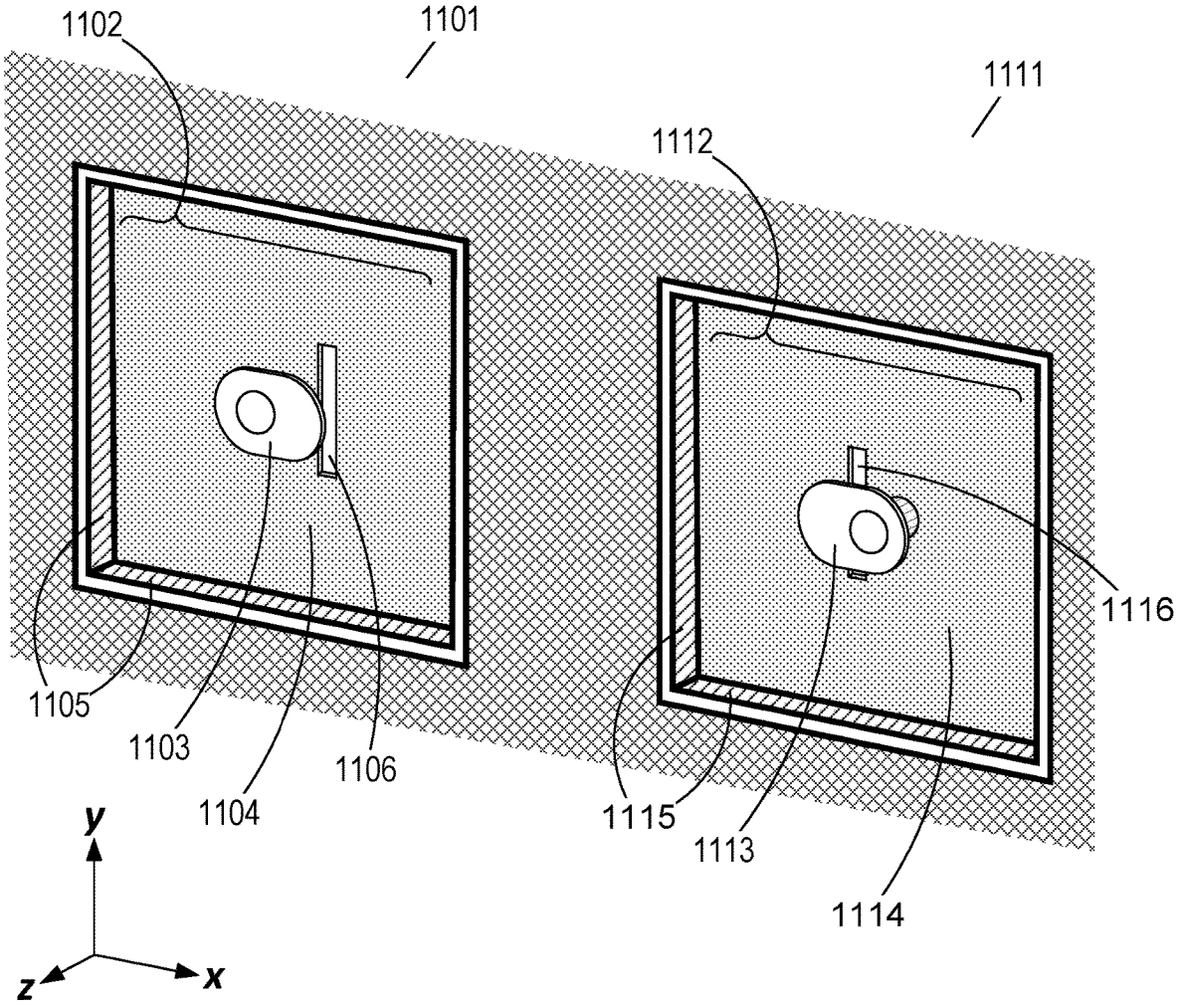
FIG. 11 illustrates a transmit-receive pair of antennas according to FIG. 10, which are configured respectively to transmit polarized signals and to receive reflections thereof, so that the receive antenna polarization is matched to the polarization of the reflected signals from all directions, according to an embodiment of the present invention.

The radiation from the upper cavity can be further assisted by a metallic resonant element disposed within upper cavity 1002. A non-limiting example illustrated in FIG. 10 and FIG. 11 is a vertical monopole resonator. Another non-limiting example is disposing a dipole or a patch in the "mouth" of the upper cavity.

FIG. 10 illustrates a coupled dual-resonator configuration 1000 for a quasi-isotropic antenna according to an embodiment of the present invention. In the cutaway view of FIG. 10, a lower cavity 1001 is electromagnetically coupled to an upper cavity recess 1002. Cavities are bounded on the side by sidewalls 1003 constructed of conducting vias (as detailed below). A lower ground plane 1004 and a middle ground plane 1005 enclose lower cavity 1001, while middle ground plane 1005 bounds upper cavity recess 1002 from below. The term "ground plane" herein denotes an electrically-conductive layer connected to a ground potential. Lower cavity 1001 is a closed cavity, whereas upper cavity recess 1002 is open at the top.

A conducting monopole element 1006*a* has its base in upper cavity 1002, where its lower end is electrically-connected to middle ground plane 1005, and it extends into upper cavity recess 1002. A PCB conducting pad 1010 is joined to the upper end of monopole element 1006*a* to form an asymmetric "gamma" configuration resonator. Pad 1010 adds capacitive coupling from the upper end of monopole element 1006*a* to middle ground plane 1005, and lowers the resonant frequency. This lowering of the resonant frequency "loads" monopole 1006*a* and shortens its effective length, thereby requiring less inductance to maintain the same resonant frequency.

The top-loaded monopole configuration of monopole element 1006*a* with pad 1010 also has an altered spatial radiation pattern. In contrast to a pure monopole antenna, which does not radiate in the z direction, monopole element 1006 with pad 1010 together form an upper resonator in a "gamma" configuration, which has a more uniform and more nearly isotropic radiation pattern. A consequence of this more nearly isotropic radiation pattern, however, is that the polarization of the radiation varies according to the direction of the radiation. Monopole element 1006*a* and pad 1010 each have linear polarizations which are mutually-orthogonal and have 90 degree relative phase. In some directions, therefore, the radiation from the combination of monopole element 1006*a* and pad 1010 has a circular polarization component. An implication of circular polarization on antenna array design is discussed below.

Returning to FIG. 10, a slot 1007 in middle ground plane 1005 provides a coupling of electromagnetic energy between lower cavity 1001 and upper cavity recess 1002, and provides excitation for upper resonator monopole element 1006*a* and pad 1010. Primary excitation of monopole element 1006*a* is provided by coupling from a quarter-wave strip-line resonator 1009 disposed within lower cavity 1001, and connected to middle ground plane 1005 and bottom ground plane 1004 by a via pin section 1006*b* and a via pin section 1006*c*, respectively. Slot 1007 in middle ground plane 1005 facilitates coupling between the current induced in lower cavity 1001 by lower resonator 1009 and monopole element 1006*a*. Input/output transmission line 1008 slightly overlaps lower resonator 1009, and the overlap thus couples the input/output transmission line 1008 to lower resonator 1009 and hence to monopole element 1006.

Lower resonator 1009 is a conducting element between lower ground plane 1004 and middle ground plane 1005 (which has slot 1007), and is shorted to ground at one end by via pin sections 1006*b* and 1006*c*. In a related embodiment monopole element 1006*a* and shorting via sections 1006*b* and 1006*c* are implemented as a single top-to-bottom via pin. It is noted that monopole element 1006*a* and via sections 1006*b* and 1006*c* are formed from a single conductor, but their RF characteristics are such that they are considered as separate elements. Although lower cavity 1001 has a resonant frequency of its own, lower resonator 1009 resonates at its own characteristic resonant frequency, and thus is the lower resonator of coupled dual-resonator configuration 1000. According to related embodiments, variations in lower resonator 1009 include changes in the placement of lower resonator 1009 along monopole element 1006*a* to alter the current distribution: in a non-limiting example, lower resonator 1009 is located in one position to operate as a quarter-wave element shorted to ground; in another non-limiting example, lower resonator 1009 is located in another position to operate as a half-wave floating element. In another non-limiting example, only via section 1006*b* to middle ground plane 1005 or via section 1006*c* to bottom ground plane 1004 is present. In another embodiment, lower resonator 1009 is located within same cavity as monopole element 1006*a*, and is coupled to monopole element 1006*a* conductively or electromagnetically, rather than by a slot between two adjacent cavities. According to this embodiment, obviating lower cavity 1001 allows the height of upper cavity 1002 to be increased.

Likewise, although upper cavity recess 1002 also has a resonant frequency of its own, the upper resonator is constructed of monopole element 1006*a* combined with pad 1010, which together resonate at their own characteristic resonant frequency, and thereby radiate and receive RF signals.

According to a further embodiment of the present invention, pad 1010 is configured to be symmetrical with respect to monopole element 1006.

In another embodiment, coupled dual-resonator configuration 1000 is implemented within a PCB having multiple layers. A top layer contains pad 1010 and defines a portion of upper cavity recess 1002; a second layer below the top layer defines the rest of upper cavity recess 1002; a third layer below the second layer contains middle ground plane 1005 with slot 1007; a fourth layer below the third layer contains lower resonator 1009 and defines a portion of lower cavity 1001; a fifth layer below the fourth layer contains input coupling 1008 and defines a portion of lower cavity 1001; and a sixth layer below the fifth layer contains lower ground plane 1004. Monopole element 1006*a* and shorting sections 1006*b* and 1006*c* are formed from a side-to-side via; and cavity walls 1003 are formed by side-to-side vias.

As previously noted, circularly-polarized radiation has implications on antenna array design. In particular, as also previously noted, a consequence of the more nearly isotropic radiation pattern of the antenna illustrated in FIG. 10, is that the polarization of the radiation varies according to the direction of the radiation, and in some directions the radiation has a circular polarization component. In a related embodiment for radar use, this has an important implication for reception of signals reflected from targets, because the reflected signal has opposite circular polarization from the transmitted signal. That is, if a right circularly-polarized signal is transmitted towards a target, the signal reflected by the target is left circularly-polarized, and vice-versa. (This is a consequence of reflection in general—whatever is right-handed will appear left-handed when reflected, and vice-versa). Thus, if an antenna is configured such that it emits circularly-polarized signals (either right or left), then it will not be able to receive the signals after being reflected. To avoid blind spots when using the antenna configuration of FIG. 10, which transmits circularly-polarized signals in some directions, a mirrored version of the configuration is used to receive reflected signals. Mirroring the antenna flips the sense of circular polarization for a given direction, matching it to the polarization sense of reflected signals. Such a configuration is illustrated in FIG. 11.

FIG. 11 illustrates a portion of an array of antennas according to an embodiment of the present invention. The illustrated portion is a transmit-receive pair including a transmit antenna 1101 and a corresponding receive antenna 1111. Only the upper portions of the antennas are shown in FIG. 11. Transmit antenna 1101 includes: an upper cavity recess 1102 where is located a monopole element with a pad 1103 (a "gamma" configuration); a middle ground plane 1104; sidewalls 1105; and a slot 1106 to a lower cavity (not shown). Likewise, receive antenna 1111 includes: an upper cavity recess 1112 where is located a monopole element with a pad 1113 (a "gamma" configuration); a middle ground plane 1114; sidewalls 1115; and a slot 1116 to a lower cavity (not shown). The difference between antenna 1101 and antenna 1111 is that the orientations of the respective monopole elements, pads, and slots are configured as mirror images of one another. Thus, a signal that is transmitted by antenna 1101 in a direction such that the signal has a circular polarization component (either right circularly-polarized or left circularly-polarized, depending on direction), is reflected back in substantially the same direction with the opposite circular polarization component (respectively left circularly-polarized or right circularly-polarized) and is readily received by antenna 1111. According to these embodiments, the polarization sense of the receive antenna is generally well-matched to the reflection of signals in a polarization sense of the transmitting antenna in all directions, be it circular, linear or elliptical, The roles of antenna 1101 and antenna 1111 are reversible, with antenna 1111 being the transmit antenna and antenna 1101 being the receive antenna.

Figure 12:
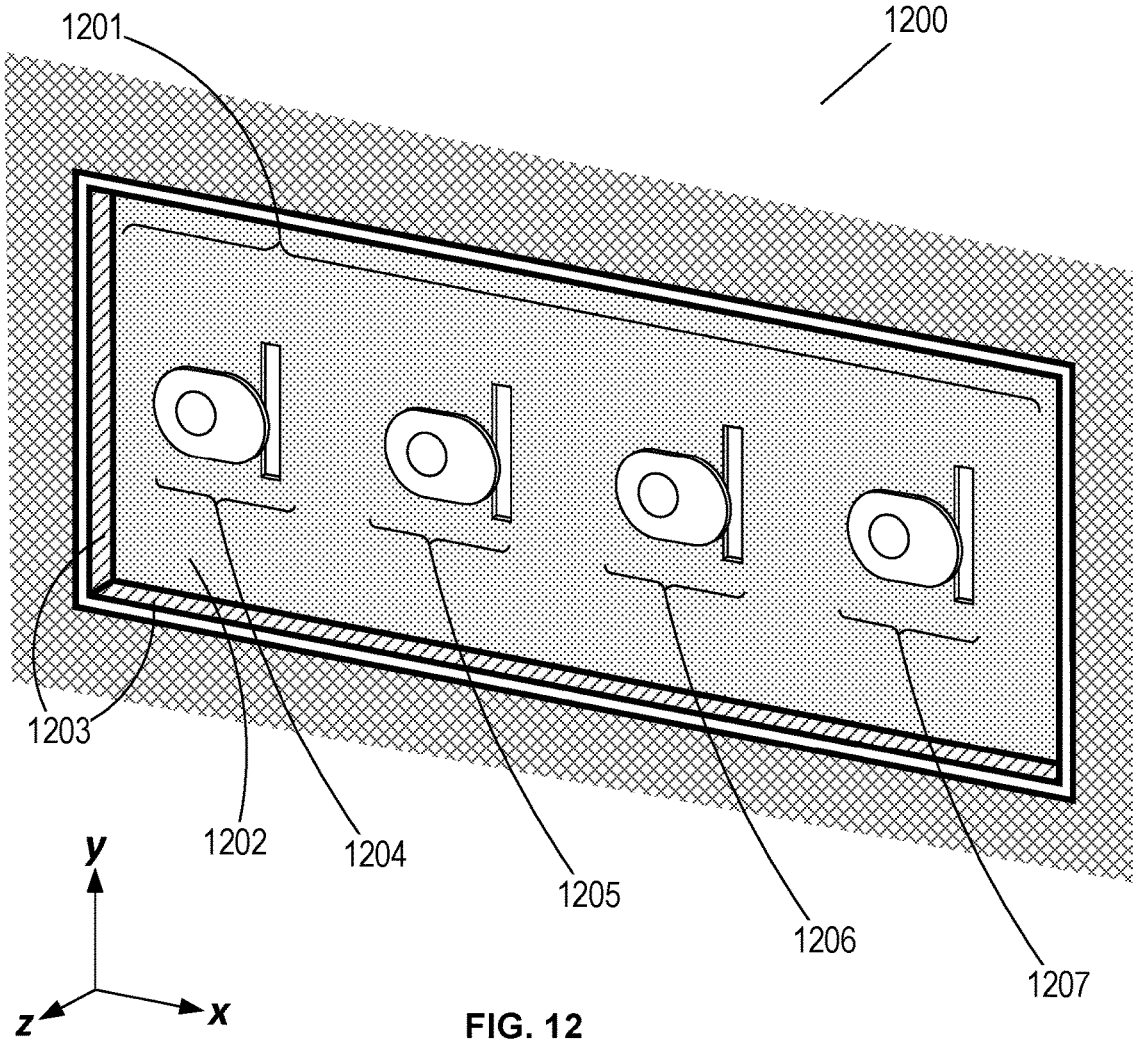
FIG. 12 illustrates an array of antennas according to an embodiment of the present invention, in which the antennas of the array share the same upper cavity.

FIG. 12 illustrates a four-element array 1200 of cavity-fed gamma-monopole antennas 1204, 1205, 1206, and 1207 according to an embodiment of the present invention, in which the antennas share a common upper cavity 1201 having sidewalls 1203. The lower cavities in this embodiment (not shown in FIG. 12) remain separate for each antenna, as illustrated in FIG. 10. In a related embodiment, the antennas also share a common lower cavity. Sharing cavities among multiple antennas reduces manufacturing complexity by reducing the number of vias, and increases the effective size of the cavity to facilitate increased bandwidth.

Figure 13A:
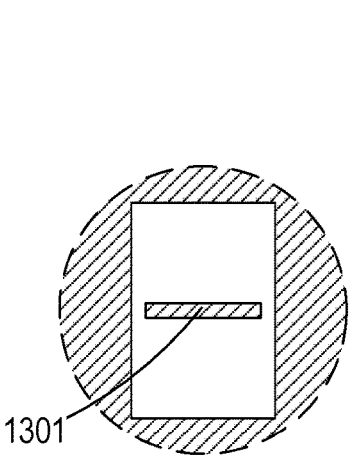
FIG. 13*a* and FIG. 13*b* illustrate dipole elements within an orifice of an upper cavity according to embodiments of the present invention.
Figure 13B:
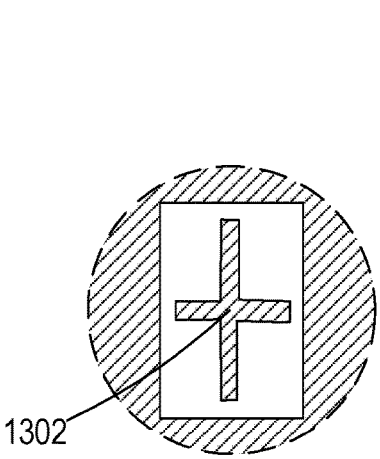
Figure 13C:
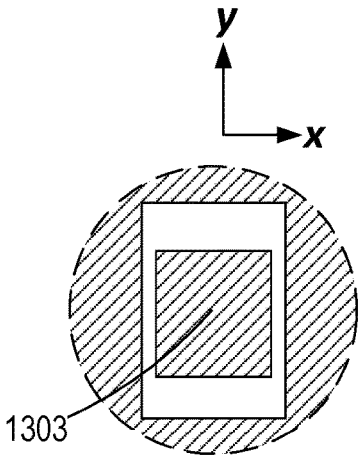
FIG. 13*c* illustrates a patch within an orifice of an upper cavity according to an embodiment of the present invention.

Other embodiments provide horizontal resonating metallic elements in the upper radiating cavity of antennas having a feeding bottom cavity as previously disclosed. FIG. 13*a* illustrates a dipole 1301 placed within the radiating orifice of the upper cavity. FIG. 13*b* illustrates a dipole 1302 placed within the radiating orifice of the upper cavity. Dipole 1302 supports two resonant modes at the same or at different frequencies in the x and y directions. FIG. 13*c* illustrates a patch 1303 placed within the radiating orifice of the upper cavity. Patch 1303 supports one or two resonant modes, at the same or at different frequencies in the x and y directions. According to these embodiments, the resonant element preferably has a resonant frequency determined by its own dimensions. Alternatively, the resonant element alters the resonant frequency of the upper cavity. In related embodiments, the resonant element is situated in the top metallization layer of the PCB; in other related embodiments the resonant element is situated in a lower layer.

In related embodiments, multiple radiating resonant elements as shown in FIG. 13*a*, FIG. 13*b*, and FIG. 13*c* are arranged in arrays placed in a common upper cavity, similar to the arrangement of monopole radiators shown in FIG. 12.

The antenna elements devised in current invention readily lend themselves to forming serially fed antenna arrays. The feeding line can extend along or through several cavities so that each antenna element taps part of the energy and lets the rest to propagate to consecutive elements. Using this arrangement, by proper phasing of the radiating elements, different radiation patterns can be realized—broadside, endfire etc. Such an arrangement can be instrumental, for example in automotive radars, where elevation beam width heeds to be narrowed while keeping the azimuth beam width of the array elements wide.

The terms "isotropic" and "quasi-isotropic" in the context of a gamma-configuration monopole based element as disclosed in FIG. 10 refers to uniform radiation into the half-space defined by middle ground plane 1005 due to its shielding effect. In a related embodiment, an array of antennas having a truly isotropic coverage is formed by disposing antennas having radiating elements or apertures on the bottom side of the PCB in addition to antenna elements having elements radiating towards the top side of the PCB. In another related embodiment, the elements are further configured to have radiating elements or apertures at both the upper and lower side of the PCB, to provide double-sided radiation. In a non-limiting example, slots are formed in both top and bottom parts of a single cavity, or, alternatively, slots in two or more different cavities. In a further embodiment, a monopole is disposed in an uppermost cavity to radiate to one side of the PCB, and another monopole disposed in the lowermost cavity to radiate to the other side of the PCB. Additional embodiments provide further augmentation by endfire elements disposed at the edges of the PCB. In a non-limiting example, at millimeter wave frequencies, the thickness of the PCB forms an aperture of a cavity or a horn radiating sideways, to further improve spatial coverage of the resulting aggregate antenna array.

It is further understood by those skilled in the art that embodiments of the present invention are applicable not only for radiating into free space or a dielectric medium, but also for radiating into a waveguide, so as to use these embodiments as a waveguide launcher, by adjusting the antenna parameters accordingly. An array of waveguide launchers according to present invention can be used for low-loss distribution of multiple signals, for example to antenna array elements in a large-aperture array.

Additional Non-Limiting Examples

As an additional non-limiting example, an antenna covering the 6-8.5 GHz band is implemented on a 1.6 mm thick PCB, using a 10-layer FR4-based stackup. The antenna uses a 10.5 mm long, 18 mm wide cavity, with a bow-tie slot having a 0.4 mm gap at the center. The intermediate open-open resonator is 9.95 mm long. The driven short-open resonator uses a virtual ground formed by capacitive stubs, to avoid a galvanic (direct current) connection to ground. The cavity walls are formed by dense rows of adjacent vias.

As a further non-limiting example, an antenna covering the 58-85 GHz band features two stacked cavities, with the upper cavity of dimensions 1.85 mm long, 2.65 mm wide, 0.7 mm high, and having a slot occupying most of the top surface. The cavity sidewalls are formed by rows of vias. The lower cavity is 0.95 mm long, 1.65 mm wide, and 0.3 mm high. The lower cavity sidewalls are formed by rows of vias, and the cavities are interconnected by an I-slot. The lower cavity is excited by a short-open resonator, which is 0.3 mm long and 0.2 mm wide.

In an embodiment, a quasi-isotropic antenna for the 76-81 GHz automotive band has a monopole element of 0.2 mm diameter and 0.25 mm height that is placed in a 2*2 mm upper cavity. The conductive pad of the monopole is of dimensions 0.40*0.55 mm, and it is asymmetric with respect to the monopole. The quarter-wave resonator in the lower cavity is of length 0.46 mm, and the coupling slot is of size 0.1*0.6 mm.

What is claimed is:

1. A radio-frequency (RF) antenna for a planar substrate, the antenna comprising:

a plurality of electrically-conductive layers within the planar substrate;

a lower cavity within the planar substrate, the lower cavity bounded by a bottom ground plane, by vertical sidewalls formed of electrically-interconnected portions of the electrically-conductive layers, and by a middle ground plane;

an upper cavity recess within the planar substrate, the upper cavity recess bounded by the middle ground plane and by vertical sidewalls formed of electrically-interconnected portions of the electrically-conductive layers;

wherein the middle ground plane has a slot which electromagnetically couples the lower cavity to the upper cavity recess;

a monopole element electrically-connected at a lower end to the lower ground plane and extending into the upper cavity recess;

wherein the monopole element is electrically-connected to a conducting strip within the lower cavity to form a lower resonator; and wherein the monopole element is electrically-connected at an upper end to a conducting pad within the upper cavity recess to form an upper resonator for radiating and receiving RF signals; and an input coupling in the lower cavity, for electromagnetically coupling the lower resonator to RF circuitry.

2. The RF antenna of claim 1, further comprising a dielectric material within the planar substrate, and wherein at least one cavity contains a portion of the dielectric material.

3. The RF antenna of claim 1, wherein the conducting strip of the lower resonator is connected to the monopole element to form a quarter-wave element shorted to ground.

4. The RF antenna of claim 1, wherein the conducting strip of the lower resonator is connected to the monopole element to form a half-wave floating element.

5. The RF antenna of claim 1, wherein the conducting pad is configured to be symmetric with respect to the monopole element.

6. The RF antenna of claim 1, wherein the conducting pad is configured to be asymmetric with respect to the monopole element.

7. An array comprising a plurality of RF antenna elements according to claim 6, wherein a first antenna of the plurality is configured to transmit an RF signal;

wherein a second antenna of the plurality is configured to receive a reflection of the RF signal; and wherein the first antenna and the second antenna are configured as mirror images of one another.

8. A radio-frequency (RF) antenna for a planar substrate, the antenna comprising:

a dielectric material within the planar substrate;

a plurality of electrically-conductive layers within the planar substrate;

a recess in an upper surface of the planar substrate;

a cavity within the planar substrate below the recess, the cavity containing a portion of the dielectric material and bounded by portions of the electrically-conductive layers and by vertical sidewalls formed of electrically-interconnected portions of the electrically-conductive layers;

an antenna feed, for electromagnetically coupling the antenna to RF circuitry;

a first resonator for radiating and receiving RF signals for electromagnetically coupling the antenna to an external RF field, the resonator including a monopole element in the cavity; and a second resonator including a horizontal transmission line in the cavity;

wherein:

the monopole element is electrically-connected at a lower end to a ground plane of the cavity and extending into the recess;

the monopole element is electrically-connected at an upper end to a conducting pad within the recess;

at least one of the horizontal transmission line resonators is electromagnetically coupled to the antenna feed; and at least one of the transmission line resonators is electromagnetically coupled to the monopole element.

9. A radio-frequency (RF) antenna for a planar substrate of claim 8, the antenna further comprising:

at least one additional cavity within the planar substrate, each additional cavity containing a portion of the dielectric material and bounded horizontally at the top and at the bottom by respective portions of two different electrically-conductive layers, and bounded vertically at all sides by vertical sidewalls formed of electrically-interconnected portions of the electrically-conductive layers;

at least one transmission line resonator disposed within at least one other additional cavity;

wherein:

the cavities are vertically stacked within the planar substrate;

each cavity is vertically adjacent to another cavity of the at least two cavities;

each cavity shares a common electrically-conductive layer with an adjacent cavity;

each common electrically-conductive layer has disposed therein a slot which electromagnetically couples a cavity to the adjacent cavity thereof; and at least one transmission line resonator is situated in an additional cavity.

10. The RF antenna of claim 9, wherein the slot between adjacent cavities is selected from a group consisting of:

a linear slot;

a curved slot;

an I-shaped slot; and a bow tie-shaped slot.

11. The RF antenna of claim 9, wherein the antenna feed electromagnetically couples the antenna to the RF circuitry by a connection selected from a group consisting of:

a galvanic connection; and a capacitive coupling.

12. The RF antenna of claim 8, wherein the wherein the conducting pad is configured to be symmetric with respect to the monopole element.

13. The RF antenna of claim 8, wherein the wherein the conducting pad is configured to be asymmetric with respect to the monopole element.

14. The RF antenna of claim 13, wherein the wherein the conducting pad is configured to extend sideways with respect to the monopole element.

15. An array comprising a plurality of RF antenna elements according to claim 14, wherein a first antenna of the plurality is configured to transmit an RF signal;

wherein a second antenna of the plurality is configured to receive an RF signal; and wherein the conducting pad of first antenna and the conducting pad of second antenna are configured to extend in opposite directions.

16. A radar device comprising an antenna array of claim 15, and having a transmitted RF signal and a received RF signal, wherein the received RF signal is a reflection of the transmitted RF signal.

17. The RF antenna of claim 8, wherein a transmission line resonator is selected from a group consisting of:

a short-open uniform resonator;

a short-open stepped impedance resonator;

a short-open tapered impedance resonator;

an open-open uniform resonator;

an open-open stepped impedance resonator; and an open-open tapered impedance resonator.

18. The RF antenna of claim 8, wherein the antenna feed electromagnetically couples the antenna to the RF circuitry by a connection selected from a group consisting of:

a galvanic connection; and a capacitive coupling.

19. An array comprising a plurality of RF antenna elements according to claim 8, wherein multiple monopole elements are disposed within a common recess.

20. The RF antenna of claim 8, wherein the planar substrate is a printed circuit board (PCB), and wherein the electrically-conductive layers are metallization layers.

21. The RF antenna of claim 20, wherein metallization layers are interconnected by a plurality of vias in the PCB.

22. The RF antenna of claim 8, wherein the planar substrate is within an integrated circuit (IC).

* * * * *